United States Patent [19]

Sakamoto et al.

[11] Patent Number: 4,512,314

[45] Date of Patent: Apr. 23, 1985

[54] FUEL CONTROL APPARATUS FOR AN INTERNAL COMBUSTION ENGINE

[75] Inventors: Toshiyuki Sakamoto; Seiji Wataya, both of Hyogo, Japan

[73] Assignee: Mitsubishi Denki Kabushiki Kaisha, Japan

[21] Appl. No.: 448,864

[22] Filed: Dec. 10, 1982

[30] Foreign Application Priority Data

Jan. 14, 1982 [JP] Japan ..... 57-5625

[51] Int. Cl.[3] ..... F02M 39/00

[52] U.S. Cl. ..... 123/459; 123/468; 123/478

[58] Field of Search ..... 123/458, 459, 464, 468–470, 123/478

[56] References Cited

U.S. PATENT DOCUMENTS

| | | | |
|---|---|---|---|
| 3,785,354 | 1/1974 | Moulds | 123/478 |
| 3,949,714 | 4/1976 | Mitchell | 123/458 |
| 3,993,030 | 11/1976 | Jaulmes | 123/470 |
| 4,369,650 | 1/1983 | Yamamoto et al. | 123/478 |

FOREIGN PATENT DOCUMENTS

| | | | |
|---|---|---|---|
| 2031064 | 4/1980 | United Kingdom | 123/470 |

*Primary Examiner*—Magdalen Y. C. Moy

*Attorney, Agent, or Firm*—Sughrue, Mion, Zinn, Macpeak, and Seas

[57] ABSTRACT

A fuel control apparatus is mounted directly on the intake tube of an internal combustion engine by means of a heat dissipating fin having a fuel passage extending therethrough. The apparatus includes a control device for controlling the operation of a fuel injection valve in accordance with various parameters such as the quantity of incoming air to the engine and the temperature of the engine. The heat generated by the control device is dissipated to the fin and the fuel passing through the passage and heat insulating material is interposed between the fin and the intake tube. The fuel passage extending through the fin may carry fuel to or from the fuel pressure controller and the fuel tank or may carry fuel from the fuel pressure controller to the fuel injection valve.

1 Claim, 2 Drawing Figures

FUEL CONTROL APPARATUS FOR AN INTERNAL COMBUSTION ENGINE

BACKGROUND OF THE INVENTION

The present invention relates to a fuel control apparatus for an internal combustion engine, and more particularly, to a fuel control apparatus employing an electronically controlled fuel injection device and the location thereof.

FIG. 1 shows a conventional fuel control apparatus for an internal combustion engine. An intake tube 1 connected to an intake port for an internal combustion engine is provided with a chamber 2 in which a fuel-air mixture is produced. A fuel injection valve 3 is provided in the chamber 2 for supplying fuel thereinto and a throttle valve 4 is provided downstream of the fuel injection valve 3 for controlling the flow rate of the fuel-air mixture. The fuel injection valve 3 is electrically connected to a control apparatus 5. The control apparatus 5 is in turn connected electrically to an incoming air sensor 6 provided in the intake tube 1 upstream of the fuel injection valve 3, for example an air sensor 6 of the hot wire type, and a water temperature sensor 8 provided on the body of the engine 7 for detecting the temperature of the water in a water cooling jacket.

According to the conventional apparatus as hereinabove described, an optimum quantity of fuel is calculated in the control apparatus 5 from the quantity of the incoming air and the engine temperature which are obtained by the air sensor 6 and the water temperature sensor 8, respectively. In accordance with the results of the calculation, the control apparatus 5 transmits a drive signal to the fuel injection valve 3, and controls the quantity of the fuel injected therethrough.

In the conventional arrangement the control apparatus 5 is mounted in the passenger compartment since the limitation as to the allowable temperature for its electronic parts makes it difficult to install the apparatus in the engine compartment in which a high temperature prevails. There is a considerable distance between the control apparatus 5 in the passenger compartment, and the fuel injection valve 3 and the air sensor 6 which are installed in the engine compartment. A considerable amount of wire and labor are, therefore, required for making electrical connections between the control apparatus 5 and the valve 3 or the sensors 6 and 8. Moreover, the wiring therebetween is likely to pick up undesirable noise from the wiring for other instruments.

SUMMARY OF THE INVENTION

It is, therefore, an object of the present invention to provide an electronic control device for a fuel injection valve of an internal combustion engine which can be mounted in close proximity to the fuel injection valve.

A further object of the present invention is to provide a fuel control apparatus for an internal combustion engine of the type having an electrically controlled fuel injection valve, a fuel pressure controller for supplying fuel at a constant pressure to said valve and a control device for controlling the operation of said valve in accordance with various parameters such as the quantity of incoming air to said engine and the temperature of said engine wherein the improvement comprises providing said control device with a radiating fin for dissipating the heat generated by said control device and associating a fuel passage with the fin to assist in dissipating the heat from said control device wherein said fuel passage may be for the fuel flowing from a fuel tank to said fuel pressure controller, the fuel returning to said fuel tank from said fuel pressure controller or the fuel supplied from said fuel pressure controller to said fuel injection valve.

The fuel control apparatus for an internal combustion engine according to the present invention will now be described in further detail with reference to the accompanying drawings showing a preferred embodiment thereof.

DETAILED DESCRIPTION OF THE INVENTION

Figure 1:
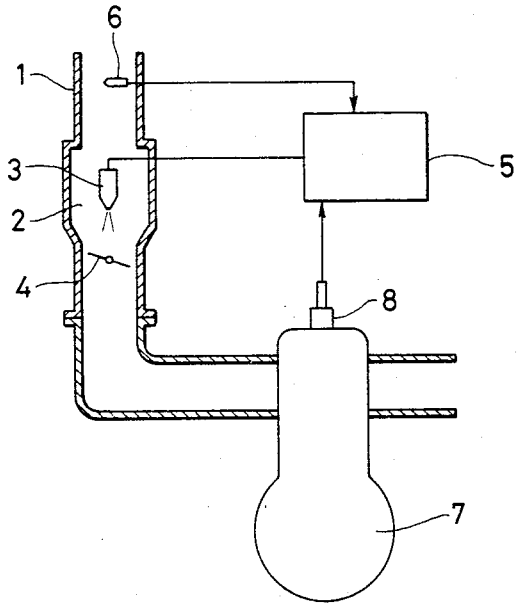
FIG. 1 is a diagrammatic view, partly in section, of a conventional fuel control apparatus for an internal combustion engine.
Figure 2:
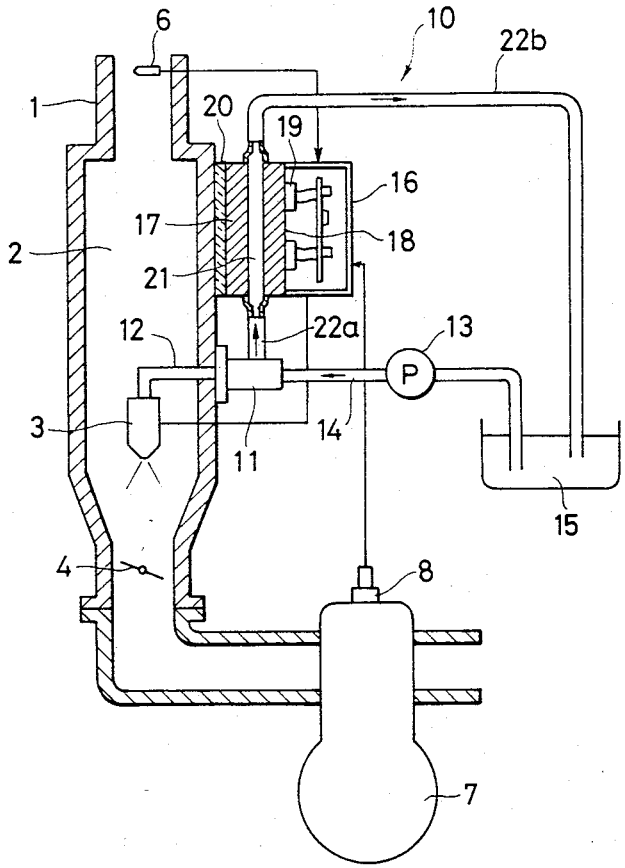
FIG. 2 is a diagrammatic view, partly in section, of a fuel control apparatus for an internal combustion engine embodying the pressure invention.

Referring to FIG. 2, there is shown a fuel control apparatus for an internal combustion engine embodying the present invention. The reference numerals used in FIG. 1 for the various parts of the conventional fuel control apparatus are employed also in FIG. 2 to indicate like or corresponding parts so that a repeat description thereof any be omitted.

The fuel control apparatus 10 embodying the present invention includes a fuel injection valve 3 which is an electrically controlled valve mounted in a fuel and air mixing chamber 2 in an intake tube 1 on an internal combustion engine. The fuel injecton valve 3 is connected by a conduit 12 to a fuel pressure controller 11 mounted on the outer wall of the mixing chamber 2. The fuel pressure controller 11 is connected to a fuel tank 15 by a conduit 14 in which a fuel pump 13 is installed.

The fuel control apparatus 10 further includes a control device 16 for controlling the fuel injection valve 3. The control device 16 is provided with a radiator 18 having a radiating fin 17 projecting outwardly from one side of the device. In the control device 16, the radiator 18 carries thereon circuit devices having a large power loss, such as a stabilized power source circuit 19 for actuating a switching element and an electronic circuit for driving the fuel injection valve 3. The control device 16 is supported on the outer wall of the mixing chamber 2 by the radiating fin 17 which is secured to the wall by any suitable means. A heat insulating material 20 is disposed between the outer wall of the chamber 2 and the end surface of the fin 17, and held in intimate contact therewith. The fin 17 is formed longitudinally with a passage 21 having one end connected to the fuel pressure controller 11 by a conduit **22*a*, while the other end of the passage 21 is connected to the fuel tank 15 by a conduit 22*b***.

According to the fuel apparatus 10 as hereinabove described, fuel is supplied under pressure from the fuel tank 15 by the pump 13, and after its pressure has been controlled to a predetermined level by the fuel pressure controller 11, it is fed to the fuel injection valve 3. As a result of pressure control by the fuel pressure controller 11, some fuel is returned into the fuel tank 15 through the conduit **22*a*, the passage 21 in the radiating fin 17, and the conduit 22*b*. The fin 17, which has absorbed heat from the power source circuit 19 and the switching element in the control device 16, is forcibly cooled by the fuel returning through the passage 21. Accordingly, it is possible to absorb the greater part of the heat generated by the switching element and the power source circuit 19 and thereby restrict any rise in the temperature of the control device 16**.

According to the invention, it is thus possible to restrict the rise in temperature of the control device, since the radiating fin is forcibly cooled by the fuel returned as a result of fuel pressure control and also to reduce the overall dimensions of the control apparatus, since even a small radiating fin provides a very high cooling efficiency. By virtue of these advantages (i.e., a restriction in temperature rise and a reduction in the dimensions of the radiating fin and the entire apparatus), it is possible to mount the control device of this invention of the intake tube with heat insulating material disposed therebetween. The heat transmitted from the engine through the intake tube does not have any appreciable effect on the control device by virtue of the presence of the insulating material and the high cooling efficiency of the radiating fin.

As a result, the control device 16 can be positioned in close proximity to the fuel injection valve 3, the air sensor 6 and the water temperature sensor 8 which are electrically connected to the control device 16. This enables drastic simplification of the wiring and an improved control accuracy of the whole system since the highly concentrated arrangement of the various components of the system permits the adjustment by the control device of all the errors made by the other components.

Although the apparatus hereinabove described by way of example utilizes the fuel returned into the fuel tank for cooling the radiating fin, it is, of course, possible to obtain the same results by utilizing the fuel flowing through the conduit between the pump and the fuel pressure controller or between the fuel pressure controller and the fuel injection valve.

As is obvious from the foregoing description, this, invention essentially consists in the forced cooling of the control apparatus by the fuel fed to the internal combustion engine. Since the rise in temperature of the control apparatus can be kept small, the apparatus can be installed in the engine compartment. The wiring for the apparatus is greatly simplified as compared with that for any conventional apparatus and the noise which the wiring picks up is drastically reduced.

While the invention has been particularly shown and described with reference to a preferred embodiment thereof, it will be understood by those in the art that various changes and details may be made therein without departing with the spirit and scope of the invention.

What is claimed is:

1. In a fuel control apparatus for an internal combustion engine including a fuel tank, an air intake tube, an electrically controlled fuel injection valve, a fuel pressure controller for supplying fuel at a constant pressure to said valve and a control device for controlling the operation of said valve in accordance with various parameters such as the quantity of incoming air to said engine and the temperature of said engine, the improvement comprising heat insulating means and said control device being provided with a radiating fin for dissipating the heat generated by said control device and fuel passage means contacting said fin to assist in cooling said fin, and conduit means connecting opposite ends of said fuel passage means to said fuel pressure controller and said fuel tank respectively, said fuel injection valve, said fuel pressure controller and said control device being installed on said intake tube and said heat insulating means being interposed between said intake tube and said fin.

* * * * *